US005396868A

United States Patent [19]

Solomon

[11] Patent Number: 5,396,868

[45] Date of Patent: Mar. 14, 1995

[54] TWO STROKE INTERNAL COMBUSTION ENGINE

[76] Inventor: Guillermo Solomon, P.O. Box 310, Santiago, Dominican Rep.

[21] Appl. No.: 209,200

[22] Filed: Mar. 10, 1994

Related U.S. Application Data

[63] Continuation-in-part of Ser. No. 21,020, Feb. 22, 1993, abandoned.

[51] Int. Cl.[6] ..... F02B 75/24

[52] U.S. Cl. ..... 123/55.2; 123/197.1

[58] Field of Search ..... 123/56 R, 56 AC, 56 BC, 123/197.1

[56] References Cited

U.S. PATENT DOCUMENTS 3,868,932 3/1975 Toth ..... 123/197.1

5,048,459 10/1991 Odai ..... 123/90.31

*Primary Examiner*—Noah P. Kamen

*Attorney, Agent, or Firm*—Charles E. Baxley

[57] ABSTRACT

A two stage internal combustion engine with horizontally opposed cylinders, which engine requires neither a crankshaft nor a camshaft nor a connecting rod nor a piston rod. Chains connected to the pistons turn a wheel mounted for conjoined rotation with a drive shaft.

8 Claims, 3 Drawing Sheets

TWO STROKE INTERNAL COMBUSTION ENGINE

This Application is a continuation-in-part of my prior application Ser. No. 08/021,020, filed on Feb. 22, 1993, abandoned.

BACKGROUND OF THE INVENTION

This invention relates to a two stroke (cycle) internal combustion engine using horizontally opposed cylinders, and more particularly to such an engine that needs neither a crankshaft, nor a camshaft, nor a connecting rod, nor a piston rod.

OBJECT AND SUMMARY OF THE INVENTION

An important object of the invention is to provide a two stroke internal combustion engine of simplified construction with respect to the prior art, and using a new mechanical system to convert linear movement to rotary movement.

Another important object of the invention is to provide such a two stroke internal combustion engine of enhanced performance relative to the prior art.

A further important object of the invention is to provide such a two stroke internal combustion engine that avoids necessity of a crankshaft, a camshaft, a connecting rod and/or a piston rod.

An additional important object of the invention is to provide such an engine that is easier to start than prior engines.

The following prior U.S. Patents may be of interest:

| U.S. Pat. No. | Date | Inventor(s) |
|---|---|---|
| 2 371 911 | 20 Mar 45 | O'Brien |
| 3 598 094 | 10 Aug 71 | Odaware |
| 3 786 790 | 22 Jan 74 | Plevyak |
| 4 453 504 | 12 Jun 84 | Freeman et al |
| 4 462 345 | 31 Jul 84 | Routery |
| 4 876 991 | 31 Oct 89 | Galitello, Jr. |
| 4 887 558 | 19 Dec 89 | Bernard |

Detailed consideration of these prior art patents will not be undertaken here, because they do not teach or suggest the present invention or any manner of achieving thee objects thereof.

SUMMARY OF THE INVENTION

An engine according to the present invention includes two or more chains, a driven shaft, two pistons, two cylinders, an admission valve, an exhaust port and two wheels carried by the shaft. Each wheel carries a ring to carry the chains, and the cylinders are mounted to a common crankcase. The cylinders accept pistons therein and the pistons are joined mechanically by rods.

An exemplary preferred embodiment of the invention is described hereinafter.

DESCRIPTION OF THE DRAWINGS

All views are schematic.

DESCRIPTION OF THE INVENTION

Figure 5:
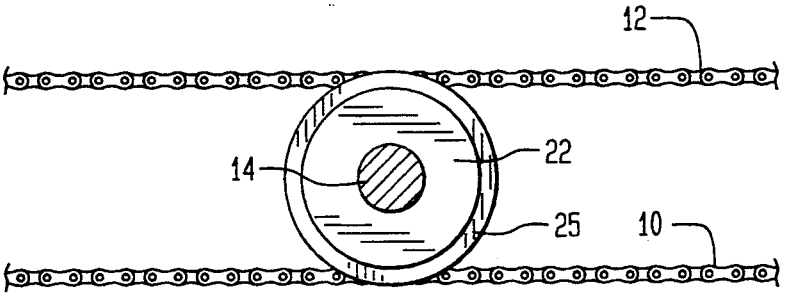
FIG. 5 shows two parallel chains, one of two wheels and a ring carrying and driven by the chains.

The motor of the invention, as stated, does not use a crankshaft, nor a camshaft, nor a connecting rod, but instead uses two parallel chains 10, 12 (FIG. 5), a driven shaft 14, two pistons 16 on either side of the shaft 14, an admission valve 18, an exhaust port 20 and two wheels 22 carried by the shaft 14. Each wheel 22 is provided with a ring 25 on its outer periphery to carry respectively the chains 10 and 12. A cylinder 24 is associated operatively with each of the pistons 16 and both the cylinders 24 are mounted mechanically on a common crankcase (not shown). The cylinders 24 accept the pistons 16 therewithin, and the pistons 16 are united mechanically by two parallel rods 26.

A pressurized air and gasoline mixture is furnished to an intake manifold through the valve 18 and an intake port 28.

Each of the pistons 16 runs inside its respective cylinder 24 and is driven mechanically by the rods 26. Thus, when one piston 16 is compressing its air/gasoline mixture, the opposite piston 16 is exploding its air/gasoline mixture, and at the end of such same movement, the piston 16 causing the explosion reaches the exhaust port 20, a fraction of a second before, admission valve 18 allows a new pressurized air/gasoline mixture to enter therethrough to be compressed when pistons 16 change direction, and another explosion occurs in the opposite direction.

The whole assembly of the pistons 16, supporting the chains 10 and 12, and the rings 25, the wheels 22 cooperate to pull and force the rings 25, the wheels 22 and the driven shaft 14 to revolve in a given direction, while the other group of parts freely rotate in the opposite direction.

Figure 1:
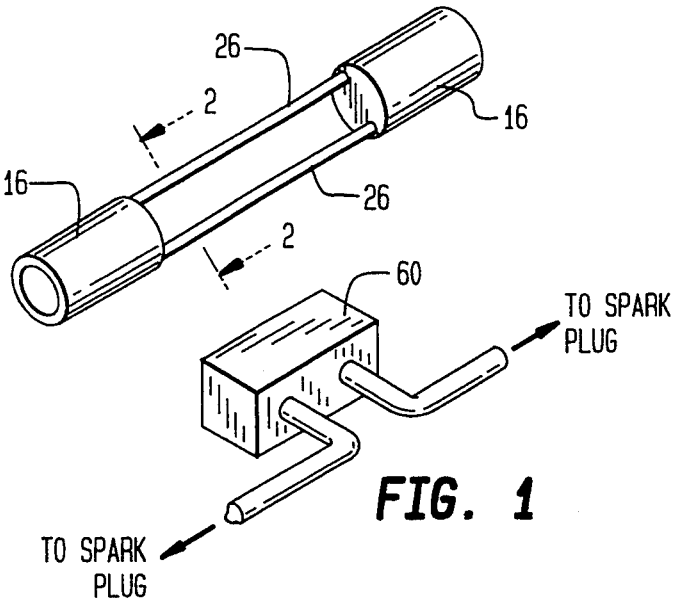
FIG. 1 is a perspective view of an engine embodying the invention.
Figure 2:
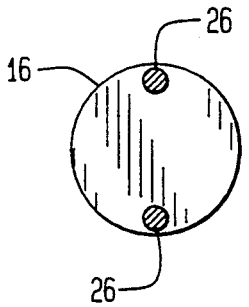
FIG. 2 is a sectional view taken on line 2—2 of FIG. 1.
Figure 3:
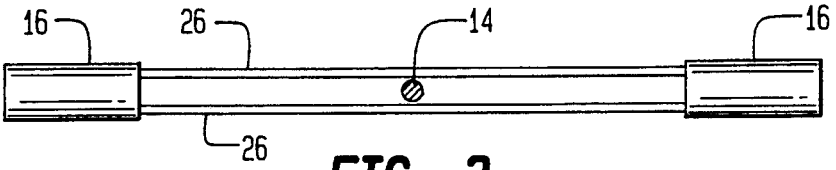
FIG. 3 shows a driven shaft with a piston at each end and related parts.
Figure 4:
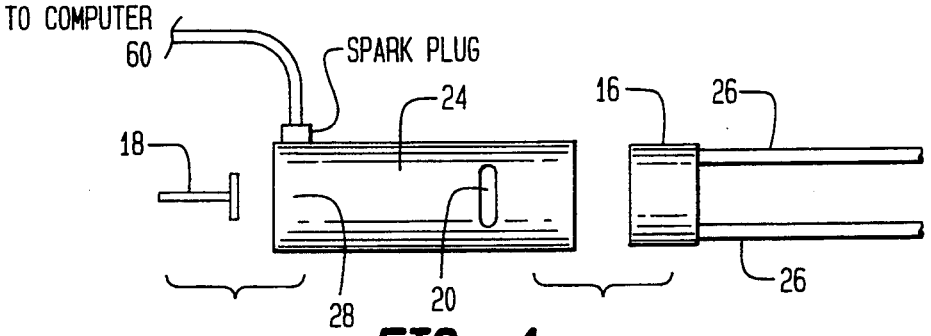
FIG. 4 shows an admission valve, a cylinder, a piston and related parts.

Spark plugs (not shown) are timed and fired by a computerized system indicated by the reference numeral 60 in FIG. 1 (not shown) which organizes timing and firing of the spark plugs. The actual position of each of the pistons 16, relative to its respective cylinder 24 when firing occurs also will be decided by measuring a given point of one of rods 26 relative to another reference point inside the crankcase (not shown).

Figure 6:
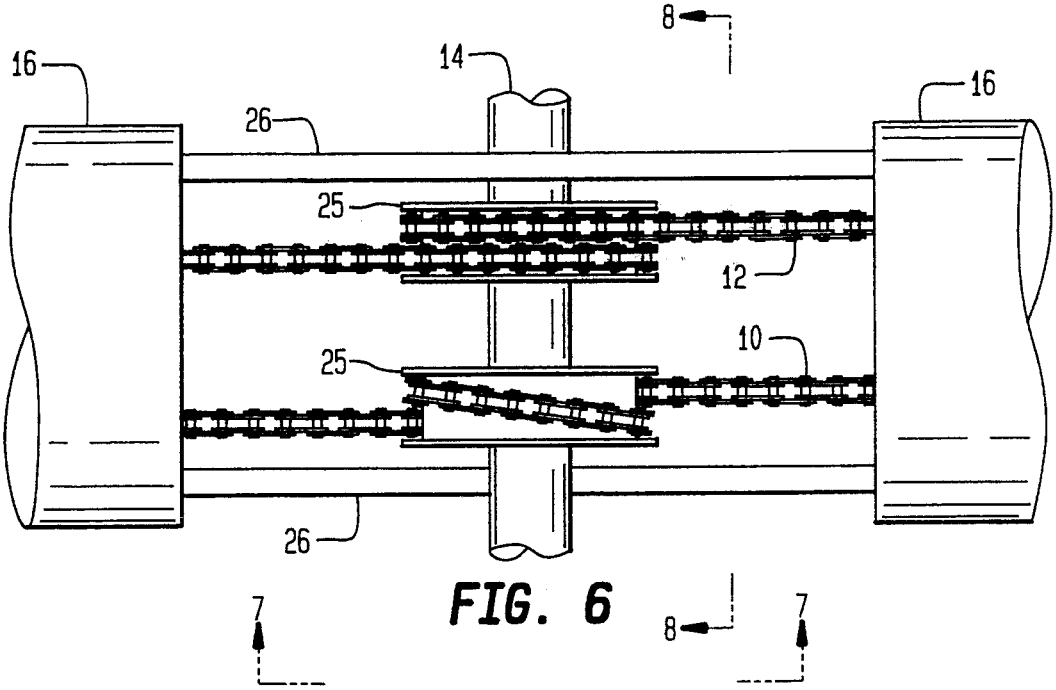
FIG. 6 is a top view including thee two pistons, the driven shaft and the parallel chains.
Figure 7:
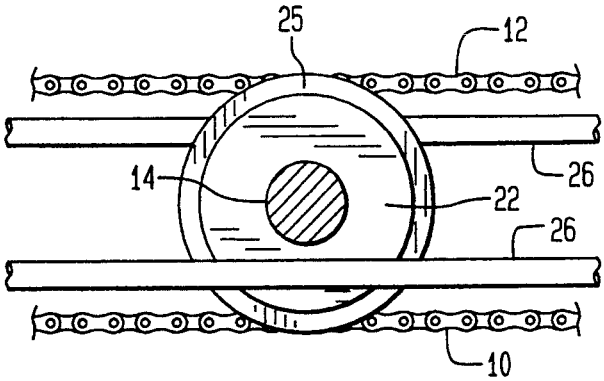
FIG. 7 is a view taken along the line 7—7 of FIG. 6.
Figure 8:
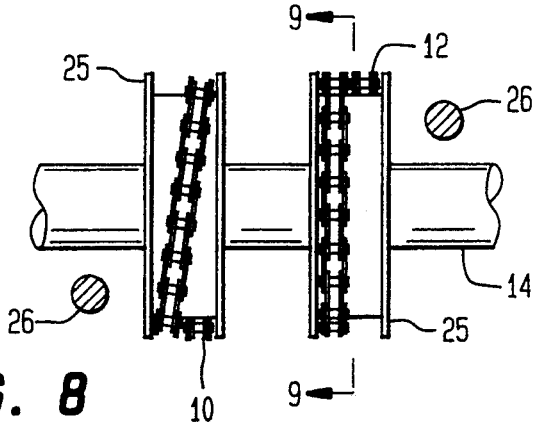
FIG. 8 is a view taken along the line 8—8 of FIG. 6.

FIGS. 6–8 show the relationship between the parallel rods 26, the chains 10, 12 and the rings 25 in greater detail.

As shown in FIGS. 6–8, the parallel rods 26 are disposed on either side of the driven shaft 14.

As is shown in FIG. 8, the rings 25 each have a plurality of internal teeth 30 formed on a surface 32. The teeth 30 each have a pair of surfaces 34, 36 one of which 34 is generally radial and one of which 36 forms an angle with the surface 34.

Figure 11:
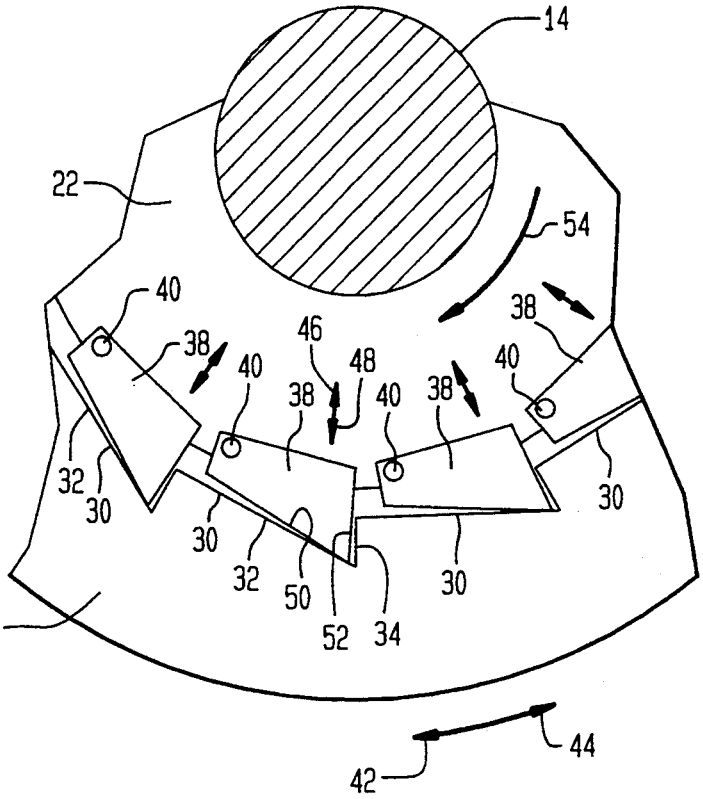
FIG. 11 is a fragmentary cross-sectional view taken along the line 9—9 of FIG. 8, showing a portion of the ring and the wheel, drawn to an enlarged scale, and showing a plurality of pivotally mounted members on the wheel for one-way engagement with the ring.

The wheels 22 have a plurality of pivotally mounted members 38 all of which are identified typically by the numeral 38. The members 38 are pivotally connected to the wheels 22 by the pins 40. The members 38 generally act in the manner of pawls and as the ring 25 is rotated in the directions shown by the arrows 42, 44 in FIG. 11, the members 38 are capable of moving in the directions shown by the arrows 46, 48.

When the ring 25 is rotated in the direction shown by the arrow 42, the surfaces 50, 52 of the members 38 engage the ring 25, as shown, and drive the wheel 22 in the single direction shown by arrow 54. When the ring 25 is rotated in the direction shown by arrow 44, the members 38 pivot radially inwardly in the direction shown by arrow 46 and the ring 25 does not move the wheel 22.

Although a relatively small number of teeth 30 and pivotally mounted members 38 have been shown in the various figures, it should be understood that this has been done for purposes of clarity of illustration and a relatively large number of teeth and a corresponding large number of pivotally mounted members may be utilized.

Figure 9:
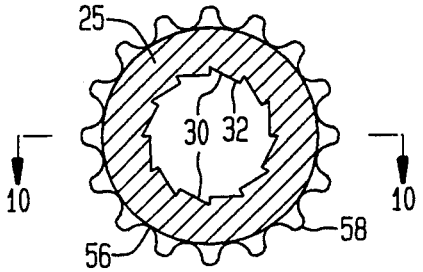
FIG. 9 is a cross-sectional view taken along the line 9—9 of FIG. 8, showing the ring removed from the wheel.
Figure 10:
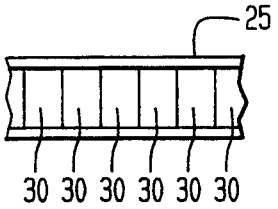
FIG. 10 is a view taken along the line 10—10 in FIG. 9, showing the construction of the internal teeth in the ring.

The outer surface 56 of the rings 25 has a plurality of gear teeth illustrated typically by the gear teeth 58 in FIG. 9, which form a driving engagement with the chains 10, 12.

It is apparent that the invention well attains the stated objects and advantages, among others.

The disclosed details are exemplary only and are not to be taken as limitations of the invention except as those details are included in the appended claims.

I claim:

1. A two stroke internal combustion engine comprising a drive shaft, first and second pistons at each side of said drive shaft, first and second cylinders such that said first piston moves reciprocally in said first cylinder and said second piston moves reciprocally in said second cylinder, a first and a second parallel chain, each connected to the first and second pistons respectively for movement therewith, a first wheel mounted on said drive shaft, a second wheel mounted on said drive shaft, a first ring mounted around said first wheel, a second ring mounted around said second wheel, with said first ring providing a periphery engaging said first chain in driving relationship therewith, with said second ring providing a periphery engaging said second chain in driving relationship therewith.

2. The engine of Claim 1, wherein said driving relationship is attained by a gear tooth engagement of said ring with said chains.

3. The engine of claim 1, further comprising a computer for controlling the firing of air/gasoline mixtures in said cylinders.

4. The engine of claim 1, further comprising a pair of rods connecting said first piston and said second piston.

5. The engine of claim 1, further comprising driving means connecting said wheel and said ring.

6. The engine of claim 5, in which said driving means comprises one-way driving means for rotation of said wheel in a single direction of rotation.

7. The engine of claim 5, in which said driving means comprises a plurality of teeth formed on said ring and a plurality of pivotally mounted members, proportioned to engage said teeth, and with said pivotally mounted members pivotally mounted on said wheel for driving said wheel in one direction of rotation.

8. The engine of claim 1, wherein each of said rings further comprise a plurality of pawls with said pawls of said first ring acting in opposite direction from said pawls of said second ring.

* * * * *